US005303132A

United States Patent [19]

Lowder

[11] Patent Number: 5,303,132

[45] Date of Patent: Apr. 12, 1994

[54] GLASS REPAIR APPARATUS AND METHOD

[76] Inventor: Robert Lowder, 110 Argentina, Bartonville, Ill. 61607

[21] Appl. No.: 732,231

[22] Filed: Jul. 18, 1991

[51] Int. Cl.[5] ..... F21V 21/08; F21V 33/00

[52] U.S. Cl. ..... 362/138; 362/278; 362/397

[58] Field of Search ..... 362/135, 138, 139, 320, 362/278, 397

[56] References Cited

U.S. PATENT DOCUMENTS

| | | | |
|---|---|---|---|
| 1,767,373 | 6/1930 | Kirlin | 362/397 |
| 1,856,519 | 5/1932 | Spears | 362/397 |
| 1,957,847 | 5/1934 | Peters | 362/135 |
| 2,052,425 | 8/1936 | Simeone | 362/397 |
| 2,598,291 | 5/1952 | O'Brien | 362/139 |
| 4,238,816 | 12/1980 | Merlo | 362/397 |
| 5,016,145 | 5/1991 | Singleton | 362/397 |
| 5,115,382 | 5/1992 | Smith | 362/397 |

FOREIGN PATENT DOCUMENTS

| | | | |
|---|---|---|---|
| 573364 | 6/1924 | France | 362/136 |
| 2618211 | 1/1989 | France | 362/138 |
| 310358 | 12/1955 | Switzerland | 362/397 |

*Primary Examiner*—Richard R. Cole
*Attorney, Agent, or Firm*—Daniel A. Sullivan, Jr.

[57] ABSTRACT

A glass repair method which provides for illumination of breaks, followed by penetrating of bonding material into the breaks. Apparatus for accomplishing the illumination is included. The apparatus includes means by which a light can be secured on the inside of a windshield to improve visibility of a break, such that a technician can work on repair of the break on the outside of the windshield.

11 Claims, 3 Drawing Sheets

FIG. 1
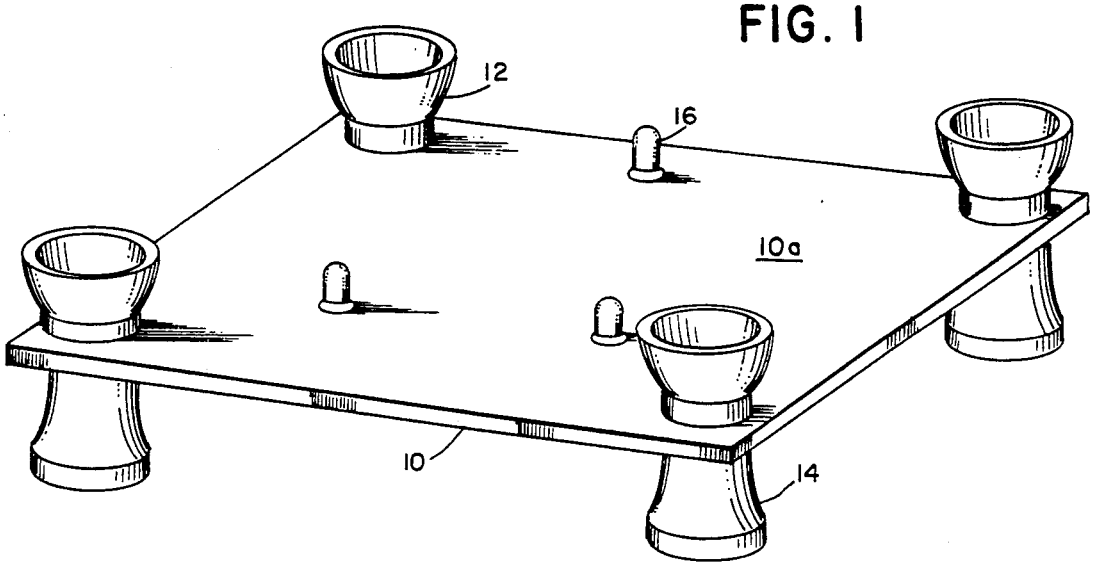
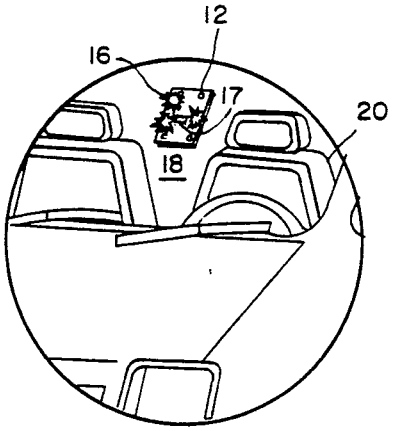
FIG. 2

GLASS REPAIR APPARATUS AND METHOD

DESCRIPTION

1. Technical Field

This invention relates to the subject of glass repair by the penetrating of bond material into breaks, or cracks, in glass and to apparatus especially advantageous for use in glass repair.

2. Background Art

U.S. Pat. Nos. 3,993,520, 4,032,272, 4,291,866, 4,419,305, 4,597,727, 4,681,520, 4,775,305, 4,776,780, 4,820,148, 4,919,602, 4,954,300, and 4,975,037 are examples of patents for method and apparatus used in the repair of glass, such as windshields, by the penetrating of bond material into breaks in the glass. See also *Auto & Flat Glass Journal,* Feb., 1991, pages 19–27, 30, and 32, and "Quick Windshield Fix", *Mechanix Illustrated,* 80:96, Jan., 1984.

DISCLOSURE OF INVENTION

The present invention aids glass repair by illuminating the true extent of breaks in the glass.

It is an object of the invention to provide method and apparatus for overcoming the above-noted difficulty with prior practice.

My method provides lighting to improve break visibility. I accomplish the method through the use of apparatus particularly suited for practice of the method.

The apparatus fundamentally comprises lighting means for emitting light and means for supporting the lighting means for illuminating a break in a glass object. The apparatus of the invention has application to fields other than glass repair.

BRIEF DESCRIPTION OF THE DRAWINGS

In the Figures, like features bear the same numerals.

FIG. 1 is a perspective view of an apparatus according to the present invention.

FIG. 2 is a perspective view showing the apparatus of FIG. 1 supported on the interior side of the windshield of a vehicle.

MODES OF CARRYING OUT THE INVENTION

Method and apparatus for repairing glass, such as vehicle windshields and window panes, are disclosed in the above-referenced U.S. patents. These repair methods inject bond material into cracks in glass. The bond material cures and the glass becomes repaired, such that replacement of the glass is not necessary.

Figure 6:
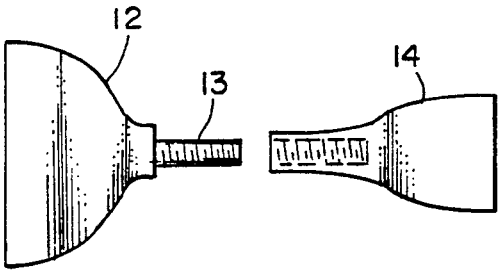
FIG. 6 is an elevational view of a suction cup, push-block combination for use in the invention.

With reference to FIG. 1, an apparatus of the invention is constructed of a plexiglass mirror 10 provided with four suction cups 12 mounted through holes drilled at the corners of its rectangular shape and secured by matching push-blocks 14 on the other side of the mirror. As is evident from FIG. 6, it is possible to unscrew the suction cup, push-block combinations, on the basis of thread stud 13, and reverse the sides of the mirror on which they are on.

Figure 5:
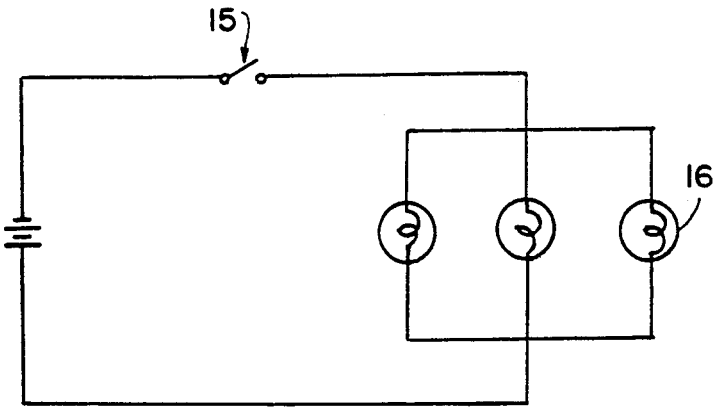
FIG. 5 is a schematic of an electrical circuit suitable for use in energizing the embodiments of FIGS. 1 and 4.

As shown in FIG. 1, the reflecting side 10a of the mirror, i.e. the side containing the suction cups, is provided with three lights 16 arranged in a triangular array. These lights are connected in parallel to a battery (not visible) on the reverse side of the mirror in the manner of FIG. 5, where on-off capability is provided by switch 15. The battery may be, for example, an ordinary 9v battery used for transistor radios and like electronic equipment. It may be mounted flat against the reverse side of the mirror.

FIG. 2 illustrates the support of the apparatus of FIG. 1 in preparation for carrying out the repair of a break 17 in a vehicle windshield 18. The apparatus has been secured to the inside of the windshield, in the passenger compartment, by pushing of the suction cups via push-blocks 14 by a technician in one of the seats 20. The flexibility of the plexiglass mirror is advantageous for adjusting to curvature in the windshield. Upon securement, the technician is free to get out of the passenger compartment and approach the outside of the windshield for performing the windshield repair using, for instance, the above-referenced repair method involving injection of bond material.

It has been found that the apparatus of FIG. 1 improves the reliability of windshield repair, particularly in low-light conditions, such as may be found in garages or at dusk or dawn. The lighting provided by the triangular arrangement of lights about the area of a break allows the true extent of the break to be seen by the technician. One sees the resin fill the cracks. The break itself is observed, or else its reflection may be observed in the mirror. The combination of lights and mirror has been found to provide a full, non-glare illumination nicely helpful to doing a good and complete repair.

Besides being useful for windshield and window pane repair, the apparatus of the invention is useful also for instance in repairing electronic instruments, appliances, engines, etc., where lighting and increased visibility is required. With a positioning of the suction cups on the battery-side of the mirror and the push-blocks on the light side, the apparatus may be pushed against, and mounted on, a rear, internal appliance panel, for instance, to provide improved interior visibility. In cases of steel panels, the push-blocks may be magnets, so that need for reversing the cup/block positions may be avoided. The apparatus of the invention may also be used as, for instance, a camping aid, for cosmetic purposes, for instance as an aid in shaving.

Figure 3:
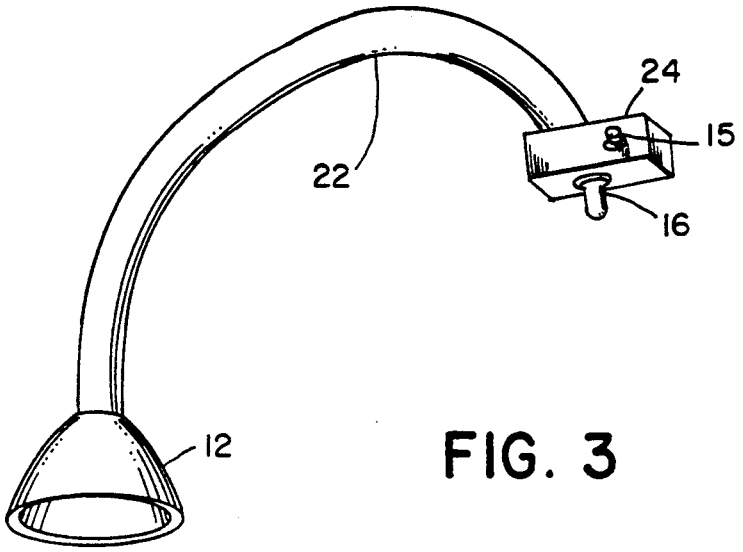
FIGS. 3 and 4 are perspective views of other apparatus according to the present invention.
Figure 4:
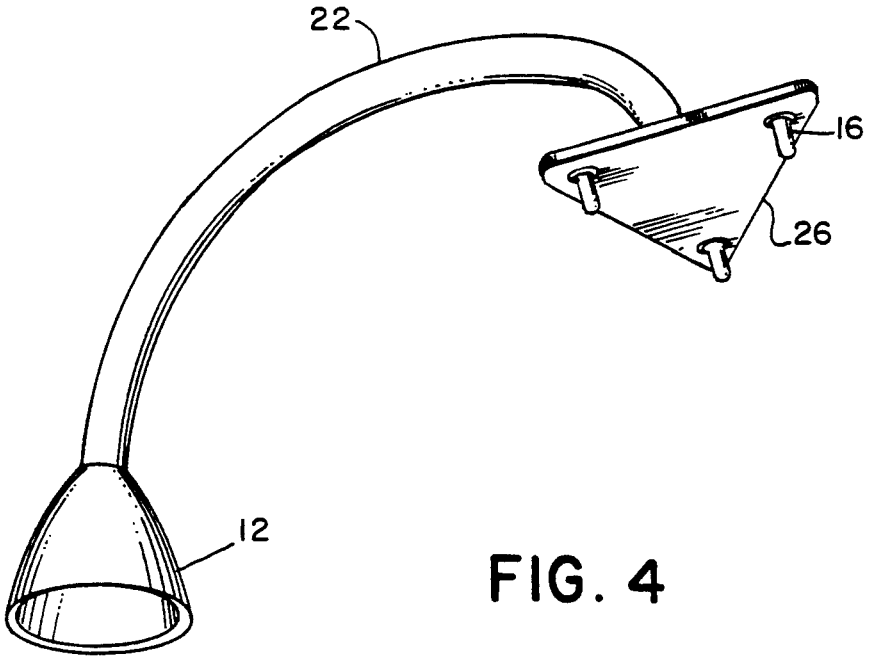

FIGS. 3 and 4 show other embodiments of apparatus of the invention. In FIG. 3, a gooseneck 22 has a battery pack 24, on-off switch 15, and light 16 at one end, and a suction cup 12 at its other end. Three of the apparatus of FIG. 3 may be arranged around a break, in a manner equivalent to the distribution of the three lights illustrated in FIG. 2. In FIG. 4, gooseneck 22 carries a triangular mirror 26; this apparatus may likewise be mounted as show in FIG. 2 to achieve an equivalent effect to that provided by the apparatus of FIG. 1.

Figure 7:
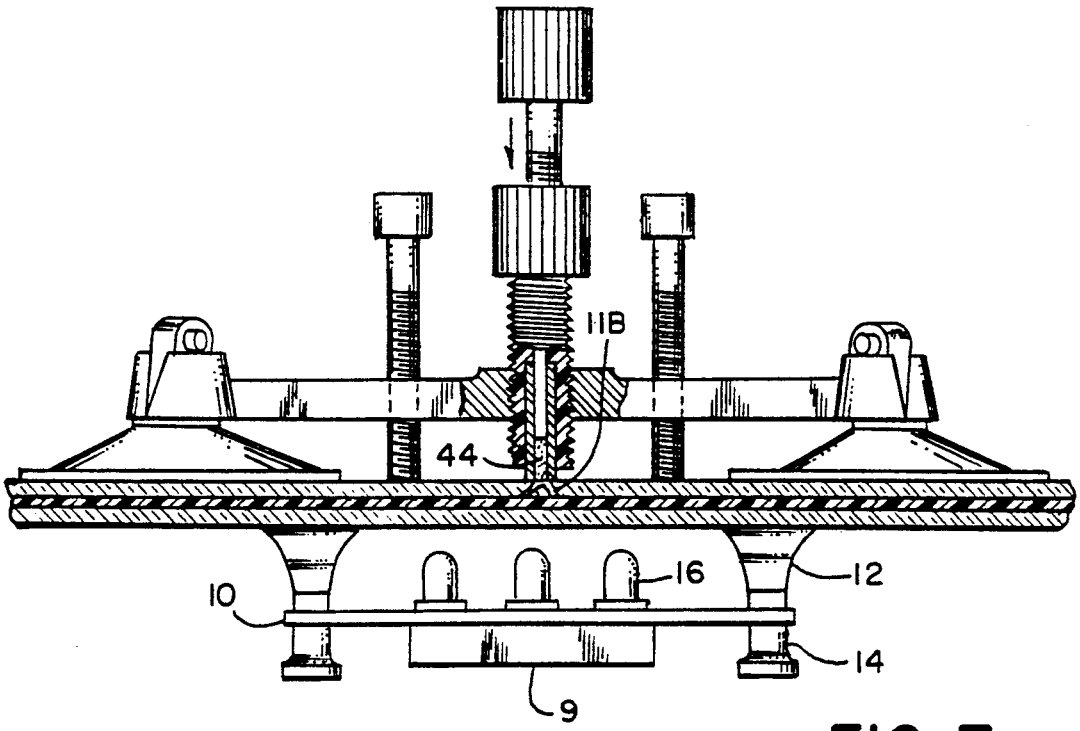
FIG. 7 is a side view of the apparatus of FIG. 1, shown in connection with the windshield and apparatus of FIG. 5 of U.S. Pat. No. 3,993,520.

FIG. 7 shows the apparatus of FIG. 1 arranged to illuminate a crack 11B while bond material 44 is being injected into the crack using the windshield repair apparatus of the above-referenced U.S. Pat. No. 3,993,520. A battery pack 9 for supplying power to the lights 16 appears on the side of the mirror opposite to side 10a.

What is claimed is:

1. An apparatus comprising a battery-powered light means and attachment means for attaching the light means to a surface, including a curved portion of a windshield, the light means and attachment means being suitable for improving visibility of a break in a glass windshield or window pane for a glass repair technician on a side of the windshield or window pane opposite a side on which the light is attached by the attachment means, further comprising a mirror means for reflecting a scene illuminated by the light means.

2. An apparatus as claimed in claim 1, the mirror means comprising a flexible mirror of a flexible material.

3. An apparatus as claimed in claim 1, the light means being mounted on the mirror means.

4. An apparatus as claimed in claim 3, the attachment means comprising a suction cup.

5. An apparatus comprising a battery-powered light means and attachment means for attaching the light means to a surface, including a curved portion of a windshield, the light means and attachment means being suitable for improving visibility of a break in a glass windshield or window pane for a glass repair technician on a side of the windshield or window pane opposite a side on which the light is attached by the attachment means, further comprising a flexible mirror of a flexible material, the light means and attachment means being mounted on the mirror.

6. An apparatus as claimed in claim 5, the attachment means comprising a suction cup.

7. An apparatus comprising a light, attachment means for attaching the light to a surface, a flexible mirror, the light and attachment means being mounted on the mirror, the attachment means comprising a suction cup, and means permitting the suction cup to be mounted on either side of the mirror.

8. An apparatus comprising a light, attachment means for attaching the light to a surface, a flexible mirror having a reflecting side, the light and attachment means being mounted on the mirror, the attachment means comprising a suction cup, the suction cup and light being mounted on said reflecting side of the mirror.

9. In combination with a glass object having a break in it, a lighting apparatus comprising a light and supporting means supporting the light for illuminating the break in the glass object, the supporting means comprising means for attaching the light to the glass object.

10. An apparatus comprising a mirror, suction cup means on the mirror and extending from a reflecting side of the mirror for securing the mirror to a windshield or window pane with the reflecting side facing the windshield or window pane and spaced therefrom, and a light means on the reflecting side of the mirror for illuminating a break in the windshield or window pane.

11. An apparatus as claimed in claim 10, the mirror having a rectangular shape with four corners, the suction cup means comprising four suction cups mounted one at each of the four corners, the light means comprising three lights arranged in a triangular array in the reflecting side of the mirror.

* * * * *